US006195940B1

(12) United States Patent
Moy

(10) Patent No.: US 6,195,940 B1
(45) **Date of Patent: *Mar. 6, 2001**

(54) POWER ACTUATOR FOR A VEHICLE WINDOW

(75) Inventor: Curtis T. Moy, Oxford, MI (US)

(73) Assignee: Saturn Electronics & Engineering, Inc., Auburn Hills, MI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 08/955,587

(22) Filed: Oct. 22, 1997

(51) Int. Cl.[7] ..... E05F 11/34
(52) U.S. Cl. ..... 49/324; 49/340
(58) Field of Search ..... 49/324, 348, 340, 49/26; 74/89.14, 42

(56) References Cited

U.S. PATENT DOCUMENTS

| | | | |
|---|---|---|---|
| 1,644,691 | 10/1927 | Pritchard . | |
| 4,186,524 | 2/1980 | Plechat | 49/324 |
| 4,403,449 | 9/1983 | Richmond | 49/340 |
| 4,918,865 | 4/1990 | Hirai | 49/347 |
| 5,036,620 | 8/1991 | Beran et al. | 49/141 |
| 5,140,771 | 8/1992 | Moy et al. | 49/340 |
| 5,161,419 | 11/1992 | Moy et al. | 74/42 |
| 5,203,113 | 4/1993 | Yagi | 49/324 |
| 5,385,061 | 1/1995 | Moy et al. | 74/42 |
| 5,680,728 | 10/1997 | Moy | 49/324 |

*Primary Examiner*—Daniel P. Stodola
*Assistant Examiner*—Curtis A. Cohen

(57) ABSTRACT

A vehicle window direct drive power actuator for pivoting a window outwardly of a vehicle body about an axis. The actuator comprises a reversible electric motor and a power transmitting gear train driven by the motor and including a rotational output gear. The rotational output gear includes stop circuit actuating member thereon for actuating a motor control circuit that controls energization of the reversible electric motor to thereby electrically control the open and closed positions of the window relative to the vehicle body. A window linkage assembly is mounted on the window in a manner to convert the rotational torque of the rotary output gear into an opening-and-closing force for the window. The linkage assembly converts the rotational torque of the rotary output gear in a one direction into a window opening force and a rotational torque in the opposite direction, caused by reversing the driving motor, into a window closing force.

4 Claims, 5 Drawing Sheets

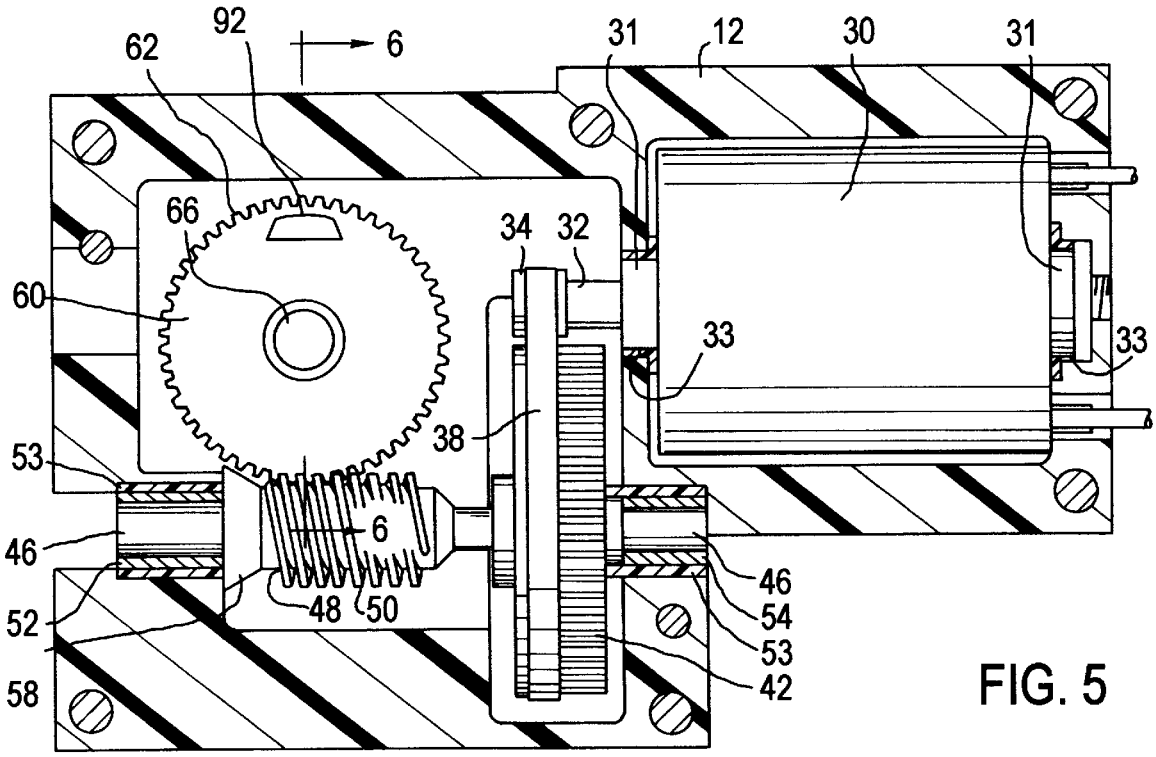
FIG. 5
FIG. 6
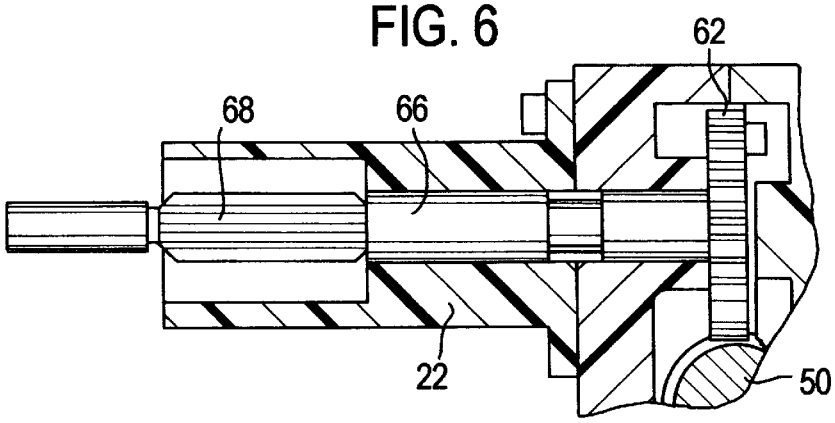

POWER ACTUATOR FOR A VEHICLE WINDOW

FIELD OF THE INVENTION

The present invention relates to a power actuator for an electrically operated vehicle window, more particularly, to a power actuator for a swingably or pivotably mounted window, such as a rear side or quarter window, of a vehicle, such as a van or the like.

BACKGROUND OF THE INVENTION

It is ofter desirable to provide a powered rear side or rear quarter window for ventilation purposes in vehicles, particularly vans and mini-vans. These rear side or quarter windows are generally swingably mounted and open outwardly of the vehicle body, and are typically remotely activated, as for example from the driver's seat.

Several types of vehicle power window actuators are known and used. Problems associated with these known types of window openers include their high cost, large and cumbersome size, weight, and indirect drive arrangement employing drive cables with a drive motor being located distant from the window. For example, U.S. Pat. No. 4,186,524 discloses a vehicle power window actuator for pivoting a glass view panel about an axis by means of complex back and forth linear movement of a wire cable. U.S. Pat. No. 4 918,865 discloses a power window opener for operation of a quarter window of an automobile comprising an actuation device, a remote electric motor, and pull cable transmitting power from the remote motor to the actuating device.

The Moy U.S. Pat. No. 5,680,728 discloses an improved compact, light weight direct drive vehicle window power actuator for a swingably mounted rear quarter power window for vehicles, such as for example only, vans and mini-vans, that overcomes the problems described in the preceding paragraph.

SUMMARY OF THE INVENTION

The present invention provides a compact, light weight direct drive vehicle window power actuator for a swingably mounted rear quarter power window of vehicles, such as for example only, vans and mini-vans, that includes an electrical stop mechanism for controlling actuator rotation and thus the open and closed positions of the window.

In one embodiment of the invention, a vehicle window direct drive power actuator for pivoting a window outwardly of a vehicle body comprises a reversible electric motor and a power transmitting gear train driven by the motor and including a rotational output gear. The rotational output gear includes stop circuit actuating means thereon for actuating a motor control circuit that controls energization of the reversible electric motor to thereby electrically control the open and closed positions of the window relative to the vehicle body. A window linkage assembly is mounted on the window in a manner to convert the rotational torque of the output gear into an opening-and-closing force for the window. The linkage assembly converts the rotational torque of the rotary output gear in a one direction into a window opening force and a rotational torque in the opposite direction, caused by reversing the driving motor, into a window closing force.

In one particular embodiment of the present invention, the stop circuit actuating means on the output gear comprises a cam-type stop member spaced proximate the periphery of the output gear to rotate therewith so as to engage one of first and second stationary normally closed limit switches of the motor control circuit spaced about the periphery of the output gear in a manner that one limit switch is actuated to cause the motor control circuit to stop the motor at a desired window "open" position and the other limit switch is actuated to stop the motor at the desired window "closed" position.

In another particular embodiment of the present invention, the stop circuit actuating means on the output gear comprises an electrically conductive wiper finger arranged to rotate with the output gear and to engage stationary arcuate electrically conductive contact traces of the motor control circuit. The lengths of the arcuate traces are varied in a manner that the wiper finger disengages therefrom at selected rotational positions of the output gear to cause the motor control circuit to stop the motor at desired window "open" and "closed" positions.

In another particular embodiment of the present invention, the motor control circuit comprises first and second circuit legs connected between a source of voltage and the motor. The circuit legs each include a diode with the diode in one leg being oppositely oriented relative to the diode in the other leg. Each circuit leg also includes means responsive to the motor control circuit actuating means for interrupting current flow in one leg in dependence on the position of the window at one of an open or closed position while the other leg remains uninterrupted to current flow. Switch means connected between the source and the circuit legs can be actuated to cause reverse current flow in the uninterrupted circuit leg in a manner to cause movement of the window to the other of the open or closed position.

The actuator of the present invention is a direct drive actuator. By direct drive actuator is meant that the driving device (motor) is located adjacent the window and transmits power to the window linkage assembly by means of gears and shafts like the aforementioned Moy U.S. Pat. No. 5,680,728 and, unlike the indirect drive actuators disclosed in U.S. Pat. Nos. 4,186,524 and 4,918,865, no cables are present as power tranmitting members.

The actuator of the present invention is advantageous in that the electrical stop mechanism for controlling the actuator reduces the amount of shock loading or stress imposed on the gear train as well stalling of the reversible motor, thus improving durability of the gear train/motor and providing possible reduction in gear train size and cost.

DESCRIPTION OF THE DRAWINGS

FIG. 5 is a top plan view partially in section of the motor and gear train disposed in one half of the housing.

FIG. 6 is a sectional view taken along line 6—6 of FIG. 5.

DETAILED DESCRIPTION OF THE INVENTION

Figure 1:
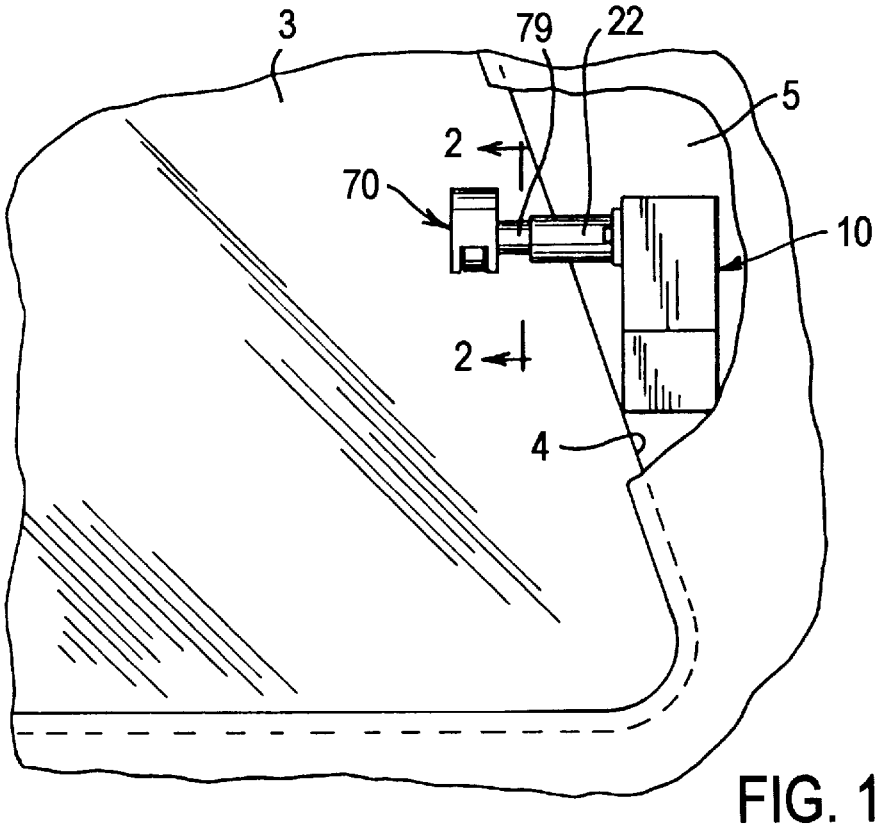
FIG. 1 is a partially cut away side elevational view showing the window actuator mounted in the interior of the vehicle and attached to a vehicle window with the window in the closed position.

As shown in FIG. 1, a power window actuator 10 in accordance with one embodiment of the invention is mounted in the interior of a vehicle on a body side panel portion of the vehicle by attachment means such as bolts, screws, and other fasteners. More particularly, the actuator 10 is mounted on the side sheet metal, for example, on the side post or pillar 5, adjacent the rear edge 4 of the rear side or quarter window. The quarter window 3 is mounted on the side body panel portion to swing laterally outward with respect to the body about an axis along the forward edge of the window.

Figure 4:
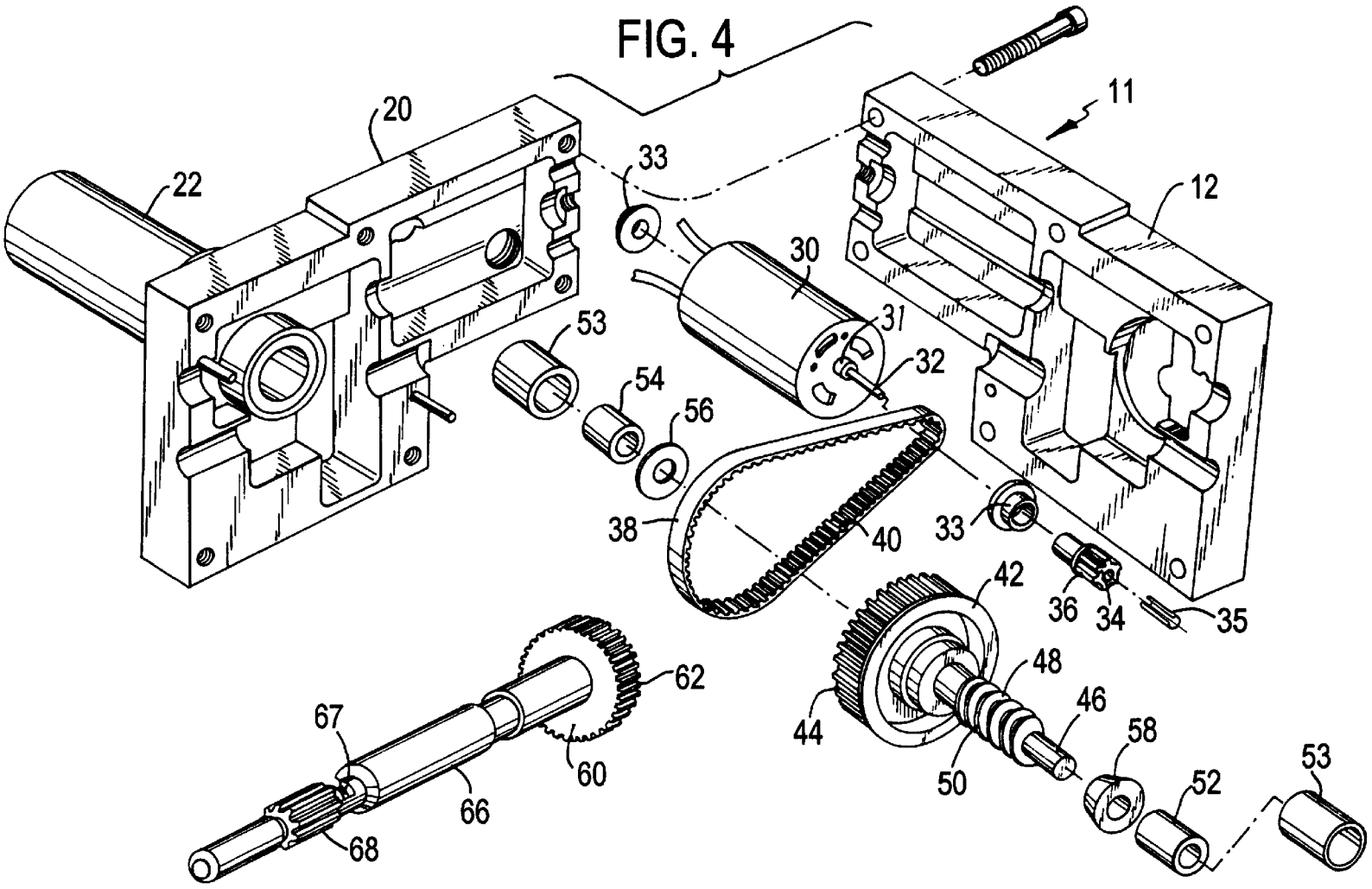
FIG. 4 is an exploded perpsective view of the actuator hosuing, motor, and gear train.

The window actuator 10 comprises a housing 11. For ease of manufacture and installation, housing 11, as best illustrated in FIG. 4, has two halves 12, 20. Disposed in the housing is a small DC electric motor 30 having motor journals 31 and an output shaft 32. Resilient bushings 33 with a flange are mounted on the motor journals 31 and function to isolate the motor from the housing 11, thereby reducing noise and vibration. The motor 30 is reversible and has circuit means associated therewith, including switch means 30*a* for selectively activating the motor alternately in one direction or the other at a switch location remote from the motor, such as proximate the driver's location. Output shaft 32 has a gear 34 at one end thereof which rotates with the rotation of output shaft 32. Gear 34 has radialy extending extending teeth 36. In a preferred embodiment of the invention, gear 34 is press fit on output shaft 32 with spring pin bushing 35.

Drive belt 38 is mounted on gear 34 and gear 42. Teeth 40 mesh with and engage radially extending teeth 36 of gear 34 and radially extending teeth 44 of gear 42. Drive belt 38 has a plurality of teeth 40 on its inner surface.

Gear 42 is mounted on shaft 46 and rotates with shaft 46. Worm 48 having teeth 50 is also mounted on shaft 46 and rotates therewith. Worm 48 is coaxial with gear 42 and is axially spaced therefrom on shaft 46. The ends of shaft 46 are rotatably disposed in tubular bearings 52, 54. Washers 56, 58 are disposed intermediate gear 42 and bearing 54, and worm 48 and bearing 52, respectively. In a preferred embodiment of the invention, resilent bushings 53 are disposed over tubular bearings 52, 54.

As best illustrated in FIG. 5, the teeth 50 of worm 48 mesh with the teeth 62 of worm output gear 60. Worm gear 60 is mounted on one end of output shaft 66 and rotates therewith. In a preferred embodiment of the invention, worm gear 60 has internal serrations and is press fit on output shaft 66. As illustrated in FIG. 6, output shaft 66 is rotatably disposed in elongated hollow tubular bearing 22 which is part of housing half 20.

Switching on of the motor 30 results in rotation of output shaft 32. Rotation of output shaft 32 results in rotation of gear 34. As gear 34 rotates, its teeth 36 engage teeth 40 of drive belt 38 and move drive belt 38. Movement of drive belt 38 results in teeth 40 of belt 38 engaging teeth 44 of gear 42, thereby rotating gear 42. Rotation of gear 42 causes rotation of shaft 46 and of worm 48. Upon rotation of worm 48, its teeth 50 engage teeth 62 of output gear 60, thereby rotating output gear 60. Rotation of gear 60 results in rotation of rotary shaft 66.

Rotation of rotary shaft 66 causes rotation of splined section 68. Splined section 68 engages a corresponding splined section in the interior of hollow tubular member 79 of the window linkage assembly 70, thereby actuating the window linkage assembly. The window linkage assembly 70 comprises a first link member 71 and a second link member 72. The first link member 71 has a base end with a hollow tubular member 79 extending therefrom and an end provided with pin-joint hole 74. The hollow tubular member has a splined portion in the interior thereof which engages splined portion 68 of shaft 66.

Figure 3:
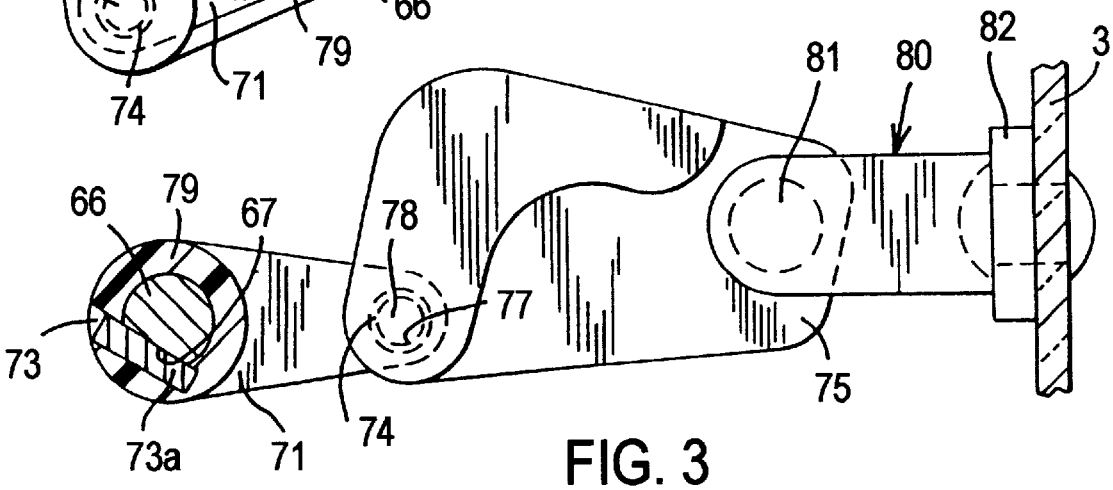
FIG. 3 is similar to FIG. 2 except the vehicle window is in the open position with the window linkage mechanism extended.

In FIG. 3, the rotary shaft 66 is locked against longitudinal movement in hollow tubular member 79 by a transversely extending roll pin 73*a*, which is positioned in a transveresly extending cavity 73 in member 79. Roll pin 73*a* passes through a complimentary shaped transversely extending cutout portion 67 in rotary shaft 66, which cutout portion 67 is aligned with cavity 73.

The second link member 72 comprises a main plate 75 and a rib 76 projecting in a lateral direction. The rib 76 has a substantially L-shaped cross-section and functions as a reinforcing member. The second link member 72 has an end having a clevice-like form provided with a pin-joint hole 77. By aligning this pin-joint hole 77 with the pin-joint hole 74 of the first link member 71 and then inserting a pin 78 through the holes 77, 74, the first link member 71 and the second link member 72 are rotatably joined together. The second link member 72 is provided with joint means at the free end thereof for attachment to attaching means 80 fixed to window glass pane 3. The attaching means 80 comprises a mounting bracket plate 82 attached to window glass pane 3. The joint means may, as illustrated, be ball joint means comprising a ball joint 81 pivotally inserted into a socket of attaching means 80.

Figure 2:
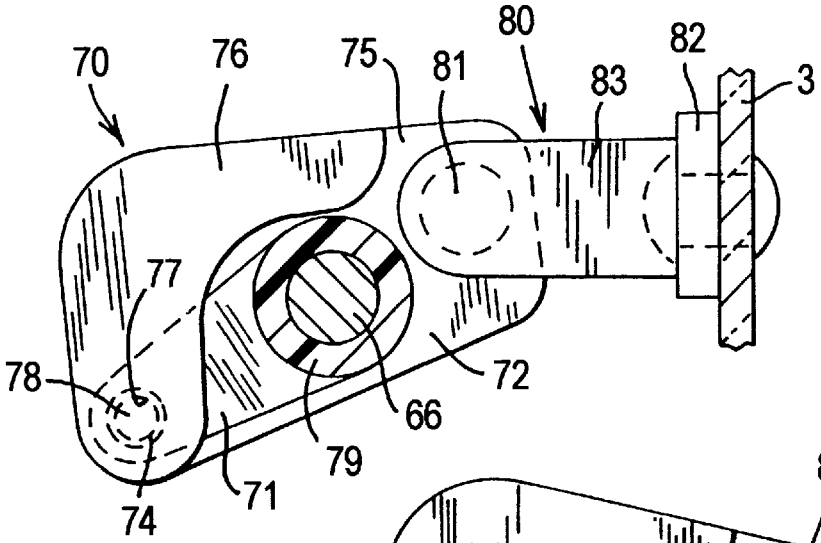
FIG. 2 is an enlarged view taken along line 2—2 in FIG. 1 showing the window linkage mechanism with the window in the closed position.

In operation, rotation of rotary shaft 66 in one direction results in rotation of the first link member in the same direction. Thus, for example, clockwise rotation of rotary shaft 66 causes rotation of first link member 71 in a clockwise direction. The second link member 72 thereby is pushed to extend, as shown in FIG. 3, and open the window. Counterclockwise rotation of rotary shaft 66 results in counterclockwise rotation of the first link member 71. The second link member 72 thereby is pulled to a folded position, as shown in FIG. 2, to close the window.

Figure 7:
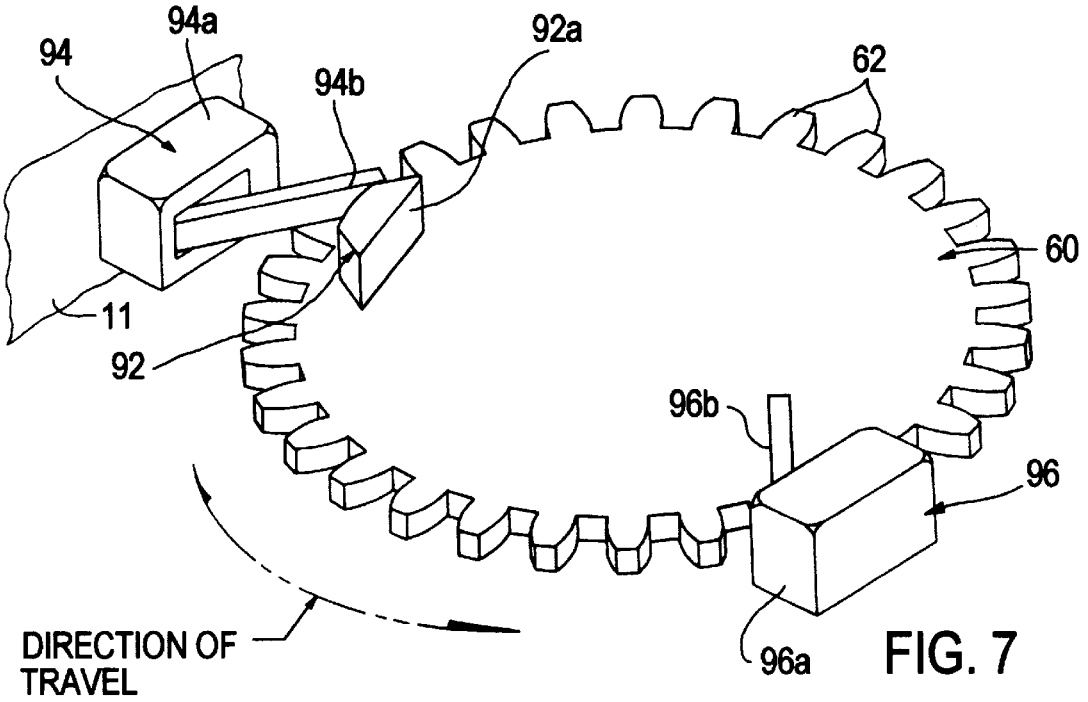
FIG. 7 is a perspective view of an output gear having stop circuit actuating member thereon and first and second normally closed switches on the housing and actuated to a respective switch open position by the stop circuit actutating member in dependence on the rotational position of the output gear.
Figure 8:
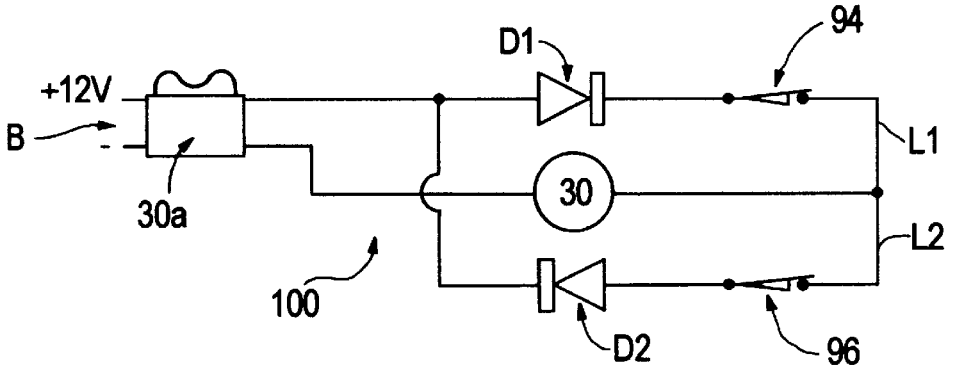
FIG. 8 is a schematic view of the motor control circuit including the switches of FIG. 7.

Referring to FIG. 7, the rotational output gear 60 includes stop circuit actuating means 92 thereon for actuating a motor control circuit 100 shown in FIG. 8 that controls energization of the reversible DC electric motor 30 to thereby electrically control the open and closed positions of the window relative to the vehicle body. In FIG. 7, the stop circuit actuating means 92 on the output gear 60 comprises an actuator cam-type stop member 92*a* spaced proximate the periphery of the output gear 60 to rotate with the output gear so as to engage one of first and second stationary normally closed limit switches 94, 96 spaced about the periphery of the output gear 60 in a manner that one limit switch is actuated to cause the motor control circuit to stop the motor at a desired window "open" position and the other limit switch is actuated to stop the motor at the desired window "closed" position. The switches 94, 96 include a respective housing 94*a*, 96*a* that is fixedly mounted at appropriate locations on the housing 11 by screws, staking, snap fit, or other fastening means so as to be located about the periphery of the output gear 60 to this end.

The switches 94, 96 also include movable switch blade or member 94*b*, 96*b* engaged by the cam-type stop member 92*a* as the output gear 60 rotates in one direction or the other. Engagement of the stop member 92*a* with the switch blade or member 94*b* or 96*b* will open the switch 94 or 96, respectively, while the other switch 94 or 96 not engaged by the stop member 92*a* remains in the closed conductive condition. For example, in FIG. 7, the left-hand switch 94 is shown engaged by stop member 92*a* in a manner that the switch 94 is now in an open switch condition to interrupt current flow. Switch 96 on the right-hand side not engaged by stop member 92*a* remains in the normally closed switch condition. Other switch means such as proximity, reed, hall effect, pushbutton, simple contacts and other switches can be used in the practice of the invention, which is not limited to any particular switch means.

The motor control circuit 100 comprises first and second circuit legs L1, L2 connected between a source of 12 volt DC voltage, such as battery B, and the motor 30. Each leg L1, L2 includes a respective diode D1, D2 and respective switch 94, 96. Current flow in one circuit leg L1 or L2 is interrupted by stop member 92*a* engaging the respective switch 94 or 96 to stop the motor 30 at a desired window position, with the other circuit leg L2 or L1 having normally closed switch 96 or 94 remaining electrically active to permit reverse current flow to the motor 30 via diode D1 or D2, as the case may be, when the driver actuates a conventional reversible window position operating control switch 30*a* to reverse movement of the window. Switch 30*a* reverses polarity of legs L1, L2 to reverse motor rotational direction when actuated by the driver and is connected between the voltage source B and the motor 30 as shown in FIG. 8.

The stop circuit actuating means, for example stop member 92*a*, on the rotary output gear 60 thus alternately engages one of the first and second stationary normally closed limit switches 94 or 96 of the motor control circuit in a manner that one of the limit switches 94 or 96 is actuated (switch opened) to cause the motor control circuit 100 to stop the motor 30 at a desired window "open" position and then the other limit switch is actuated (switch opened) to stop the motor at the desired window "closed" position with the remaining electrically active circuit leg L1 or L2 permiting reversal of current flow through the motor 30 when the driver actuates the reversible window position control switch 30*a* to reverse movement of the window from the "closed" to the "open" position, or vice versa.

Figure 9:
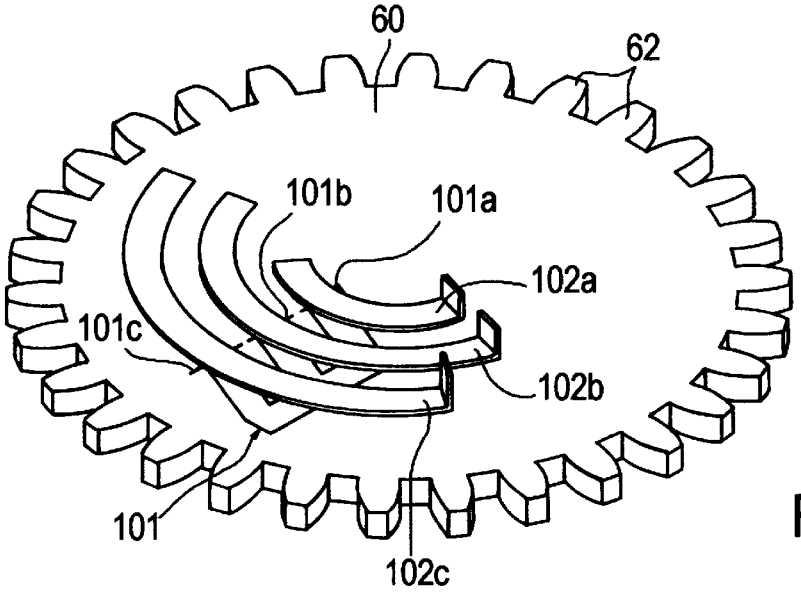
FIG. 9 is a perspective view of an output gear having stop circuit actuating wiper or finger thereon for selectively enagaging multiple traces on the housing in dependence on the rotational position of the output gear.
Figure 10:
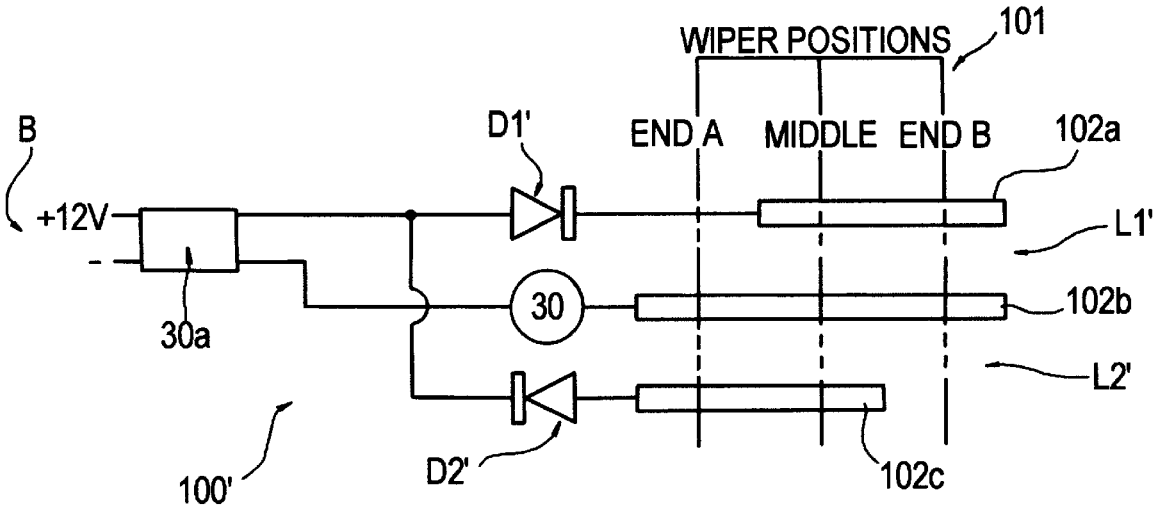
FIG. 10 is a schematic view of the motor control circuit including the wiper finger and traces of FIG. 9.

Referring to FIG. 9, in another embodiment of the invention, the rotational output gear 60 includes different stop circuit actuating means thereon for actuating a motor control circuit 100' shown in FIG. 10 that controls energization of the reversible DC electric motor 30 to thereby electrically control the open and closed positions of the window relative to the vehicle body. In FIG. 9, the stop circuit actuating means comprises a plurality of (e.g. 3) electrically conductive resilient wipers or fingers 101*a*, 101*b*, 101*c* of a common metal contact 101 to form an E-shaped contact configuration. The contact 101 is affixed on the output gear 60 so as to rotate with the output gear with each finger extending toward a respective stationary arcuate electrically conductive metal contact trace 102*a*, 102*b*, 102*c* to engage same. The contact traces are fixedly disposed on the actuator housing 11 by insert molding, staking, snap fit or other fastening means and are connected at their upturned ends extending into housing 11 to appropriate electrical lead connectors (not shown) therein to form the motor control circuit of FIG. 10. The lengths of the arcuate contact traces 102*a*, 102*c* are varied in a manner that the wipers or fingers disengage therefrom at selected rotational positions of the output gear 60 to cause the motor control circuit of FIG. 10 to stop the motor 30 at at desired window "open" and "closed" positions. In FIG. 9, the wipers or fingers and the contact traces (shown straightened for convenience) in effect form first and second switches in circuit legs L1', L2', as illustrated, in a manner similar to circuit legs L1, L2 described hereabove.

In particular, when the end of travel of the output gear 60 in one direction reaches an end position shown corresponding to a desired window "closed" or "open" position, the then active leg L1' or L2' of the circuit is deactivated, stopping current to the motor 30.

The remaining leg L1' or L2' remains electrically active to permit reverse current flow to the motor 30 through its diode D1' or D2' when the driver actuates a conventional reversible window position control switch 30*a* to reverse movement of the window. Switch 30*a* reverses polarity of legs L1', L2' to reverse motor rotational direction when actuated by the driver and is connected between the voltage source B and the motor 30 as shown in FIG. 10.

The stop circuit actuating means, for example contact 101, on the rotary output gear 60 thus alternately opens circuit leg L1' or L2' of the motor control circuit in a manner that one of the legs L1' or L2' is deactivated to cause the motor control circuit 100' to stop the motor 30 at a desired window "open" position and then the leg L1' or L2' is deactivated to stop the motor at the desired window "closed" position. The remaining electrically active circuit leg L1' or L2' permits reversal of current flow through the motor 30 when the driver actuates the reversible window position control switch 30*a* to reverse movement of the window from the "closed" to the "open" position, or vice versa.

In lieu of the simple motor control circuit shown in FIGS. 8 and 10, the invention also contemplates use of control logic electronics to sense the position of switches 94, 96 and adjust the current provided to motor 30 accordingly to provide an electrical stop mechanism for controlling actuator rotation and thus the open and closed positions of the window. Such control logic electronics can embody a control logic unit, such as a microprocessor, already on a vehicle for controlling body elements, such as doors, relay logic, or other on-board vehicle microprocessor. Morever, the present invention contemplates use of linear power transmitting means, rather than rotational power transmitting means described (e.g. gear train having rotational output gear 60) to connect the motor 30 to the linkage assembly 70. Thus, variations and modifications of the invention are possible without departing from the scope of the invention as defined in the appended claims.

What is claimed is:

1. A direct drive window actuator for pivotally opening and closing a pivotal vehicle window on a vehicle body, comprising:

a housing, a reversible electric motor, power transmitting means connected to said motor and having a movable output member with stop circuit circuit actuating means thereon for movement therewith, linkage means for operably connecting said output member to said window and converting movement of said output member for pivotally opening and closing said window, motor control means that controls energization of said reversible electric motor in response to the position of said actuating means for electrically controlling opening and closing of the window relative to a vehicle body, said motor control means including first and second circuit legs connected to a source of voltage and to said motor, said legs each having a diode with the diode in one leg being oppositely oriented relative to the diode in the other leg and each leg including electrical stop circuit means responsive to the position of said actuating means for interrupting current flow in one leg in dependence on the position of the window at one of an open or closed position while the other leg remains uninterrupted to current flow.

2. The actuator of claim 1 wherein said electrical stop circuit means responsive to said actuating means comprises a switch in each leg.

3. A direct drive window actuator for pivotally opening and closing a pivotal vehicle window on a vehicle body, comprising:

a housing, a reversible electric motor, power transmitting means connected to said motor and having a rotational output gear with an electrically conductive wiper thereon for rotation therewith, linkage means for operably connecting said output member to said window and converting rotational movement of said output member into an opening and closing movement of said window, and motor control means that controls energization of said reversible electric motor, said motor control means including a manually operable reversible window position control switch and further including an electrical stop circuit means comprising a plurality of stationary arcuate electrically conductive traces disposed on said housing with said traces being of different lengths such that said wiper disengages from contact therewith at selected rotational positions of said output gear to cause said motor control means to stop said motor at a desired window open position or window closed position.

4. A direct drive window actuator for pivotally opening and closing a pivotal vehicle window on a vehicle body, comprising:

a housing, a reversible electric motor, power transmitting means connected to said motor and having a rotational output gear with an electrically conductive wiper thereon for rotation therewith, linkage means for operably connecting said output member to said window and converting movement of said output member for pivotally opening and closing said window, and motor control means that controls energization of said reversible electric motor, said motor control means including a manually operable reversible window position control switch operable by a vehicle driver or passenger and further including an electrical stop circuit means comprising a plurality of stationary arcuate electrically conductive traces disposed on said housing with said traces being of different lengths such that said wiper disengages from contact therewith at selected rotational positions of said output gear to cause the motor control means to stop said motor at a desired window open position or window closed position.

* * * * *